US009256154B2

(12) United States Patent
Akagi

(10) Patent No.: US 9,256,154 B2
(45) Date of Patent: Feb. 9, 2016

(54) IMAGE FORMING APPARATUS WITH DARK CURRENT COMPENSATION FOR AUTOMATIC POWER CONTROL (APC)

(71) Applicant: CANON KABUSHIKI KAISHA, Tokyo (JP)

(72) Inventor: Daisuke Akagi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/467,986

(22) Filed: Aug. 25, 2014

(65) Prior Publication Data

US 2015/0062276 A1 Mar. 5, 2015

(30) Foreign Application Priority Data

Sep. 3, 2013 (JP) ..... 2013-181921

(51) Int. Cl.
*B41J 2/435* (2006.01)
*G03G 15/043* (2006.01)

(52) U.S. Cl.
CPC ..... *G03G 15/043* (2013.01); *G03G 2215/0404* (2013.01)

(58) Field of Classification Search
CPC ..... G03G 15/043; G03G 2215/0402; G03G 2215/0404; G03G 2215/0407; G03G 2215/04; G03G 2215/0409; B41J 2/442; B41J 2/45; B41J 2/471; B41J 2/473; G02B 26/123
USPC ..... 347/236, 237, 246, 247
See application file for complete search history.

(56) References Cited

U.S. PATENT DOCUMENTS

| | | | | |
|---|---|---|---|---|
| 8,379,681 | B2 * | 2/2013 | Kyogoku | 372/38.01 |
| 8,483,250 | B2 * | 7/2013 | Kamatani | 372/38.02 |
| 2011/0204795 | A1 | 8/2011 | Uehara | 315/152 |
| 2013/0162746 | A1 | 6/2013 | Akagi | 347/118 |

FOREIGN PATENT DOCUMENTS

| | | |
|---|---|---|
| JP | 2004-153148 | 5/2004 |
| JP | 2011-170219 | 9/2011 |

OTHER PUBLICATIONS

U.S. Appl. No. 14/290,586, filed May 29, 2014.

* cited by examiner

*Primary Examiner* — Hai C Pham
(74) *Attorney, Agent, or Firm* — Fitzpatrick, Cella, Harper & Scinto

(57) ABSTRACT

An image forming apparatus, including: a laser light source supplied with a bias current and a superimposed current to emit laser light; a splitting unit configured to split the laser light into first and second laser lights; a photoelectric conversion unit configured to output a voltage corresponding to a light intensity of the second laser light; a voltage holding unit configured to hold a voltage output from the photoelectric conversion unit with not the superimposed current but the bias current being supplied to the laser light source; a voltage conversion unit configured to remove the voltage held by the voltage holding unit from the voltage from the photoelectric conversion unit which receives the second laser light; and a current control unit configured to control, based on a voltage from the voltage conversion unit, a value of the superimposed current supplied to the laser light source based on image data.

7 Claims, 9 Drawing Sheets

415
GND
407
BIAS CURRENT GENERATING CIRCUIT
Ib
410
Iop
409
406
VOLTAGE-CURRENT CONVERTING CIRCUIT
408
405
404
Vpdg
Vref
REFERENCE VOLTAGE GENERATING UNIT
403
211
402
GAIN SETTING UNIT
Vpd
APC-n
IMAGE DATA p
IMAGE DATA n
LDn LDn-1 LD2 LD1
201
208
411
CURRENT-VOLTAGE CONVERTING CIRCUIT
412
413
414
SUBTRACTING CIRCUIT
S/H SIGNAL
210
207
BD
212
SEQUENCE CONTROLLER
401
IMAGE DATA GENERATAING UNIT

IMAGE FORMING APPARATUS WITH DARK CURRENT COMPENSATION FOR AUTOMATIC POWER CONTROL (APC)

BACKGROUND OF THE INVENTION

1. Field of the Invention

The present invention relates to an image forming apparatus including a light scanning device.

2. Description of the Related Art

Hitherto, there has been known an electrophotographic image forming apparatus in which a laser light (hereinafter referred to as a light beam) emitted from a light source is deflected by a rotary polygon mirror, and a surface of a photosensitive member is scanned by the deflected light beam to form an electrostatic latent image on the surface of the photosensitive member. The electrophotographic image forming apparatus is configured to form an image on a recording medium by use of an electrophotographic image forming process. Examples of the electrophotographic image forming apparatus include an electrophotographic copying machine (for example, a digital copying machine), an electrophotographic printer (for example, a color laser beam printer, a color LED printer, or the like), a multifunctional peripheral (MFP), a facsimile machine, and a word processor. The electrophotographic image forming apparatus (hereinafter referred to as an image forming apparatus) is not limited to an image forming apparatus configured to form a monochrome image, and but may include a color image forming apparatus.

The image forming apparatus is configured to execute automatic power control (hereinafter abbreviated to as APC) in order to control the light intensity of the light beam emitted from a light scanning device in order that the light intensity matches a target light intensity. With the APC, the light beam emitted from the light source enters an optical sensor from which an output is fed back to control a drive current to be supplied to the light source based on the output from the optical sensor. By executing the APC, the light intensity of the light beam is controlled to match the target light intensity.

FIG. 7 is a schematic view of a package 510 of an edge emitting laser (EEL) 500 serving as the light source. The edge emitting laser 500 emits respective light beams 503 and 504 in two directions indicated by the arrows A and B from half mirrors 502 formed on both end surfaces of a semiconductor laser chip 501. The light beam 503 emitted in the direction indicated by the arrow A is referred to as a front light, and the light beam 504 emitted in the direction indicated by the arrow B is referred to as a rear light. The front light 503 is guided to the surface of the photosensitive member to form an electrostatic latent image on the surface of the photosensitive member.

FIG. 8 is a graph showing a relationship between the light intensity of the front light 503 and the light intensity of the rear light 504 of the edge emitting laser 500. As shown in FIG. 8, there is a correlation between the light intensity of the front light 503 and the light intensity of the rear light 504. The light intensity of the rear light 504 linearly changes in accordance with the light intensity of the front light 503.

With use of this characteristic, for the edge emitting laser 500, an optical sensor 505 (photoelectric conversion element) is provided in the package 510 as illustrated in FIG. 7 so that the rear light 504 enters the optical sensor 505 for execution of the APC.

By the way, in a case of a surface emitting laser (vertical cavity surface emitting laser: VCSEL), as compared to the edge emitting laser 500, a plurality of light emitting elements may be easily arrayed on one surface of a single semiconductor laser chip. The surface emitting laser emits a light beam in one direction. Therefore, an image forming apparatus comprising the surface emitting laser is provided with, as configurations for executing the APC, a beam splitter configured to split a light beam emitted from the surface emitting laser into two light beams, and an optical sensor arranged separately from the semiconductor laser so that one of the split light beams enters the optical sensor. The image forming apparatus executes the APC based on the light receiving result of the light beam entering the optical sensor (Japanese Patent Application Laid-Open No. 2004-153148).

In the image forming apparatus including the surface emitting laser, the light beam split by the beam splitter enters the optical sensor, and hence, as compared to the image forming apparatus including the edge emitting laser, the light intensity of the light beam that can enter the optical sensor is lower.

In general, a photodiode is used as the optical sensor. The photodiode outputs a current corresponding to the intensity of the incident light. However, the photodiode also has a characteristic of outputting a dark current when the photodiode is not irradiated by light. The amount of the dark current to be generated by the photodiode changes depending on temperature.

In general, the dark current has an extremely small current value such as several nanoamperes to several hundred nanoamperes. Therefore, when a light intensity of the light beam entering the photodiode is large to a certain extent, the dark current is negligible. However, when the APC is executed for the surface emitting laser, the light intensity of the light beam entering the photodiode is very small as described above, and hence the influence of the dark current cannot be neglected.

Further, in the image forming apparatus, in order to improve the output responsiveness of the light beam, in general, a predetermined bias current is supplied in advance to the semiconductor laser serving as the light source.

FIG. 9 is a graph showing a relationship between a current supplied to a semiconductor laser and an output light intensity. In order to improve the output responsiveness of the light beam, a bias current Ib is supplied to the semiconductor laser. The bias current Ib is smaller than a current value (threshold current) Ith at which the semiconductor laser starts laser oscillation. When the bias current Ib is supplied to the semiconductor laser, the semiconductor laser enters a spontaneous emission state. In the spontaneous emission state, the semiconductor laser emits low light (hereinafter referred to as "LED light") having a wide wavelength range similarly to the LED. When the number of the light emitting elements is small, the light intensity of the LED light does not reach a level to change the potential of the photosensitive member. Therefore, during image formation, the bias current Ib is supplied to each of the light emitting elements of the semiconductor laser, and the semiconductor laser is driven while superimposing a current onto the bias current Ib to excite the laser oscillation.

However, the recent image forming apparatus tends to have a semiconductor laser including a plurality of light emitting elements in order to increase speed and image resolution. When the number of the light emitting elements increases, the influence of the light intensity of the LED light of the semiconductor laser cannot be neglected.

As a general technology of removing an offset component (DC component) such as the dark current and the LED light, there is known a system of extracting only an AC component by connecting a capacitor in series to an output terminal of the optical sensor (light receiving element). According to this technology, if the relationship between a time period in which light enters the optical sensor and a time period in which light does not enter the optical sensor is always constant, only the AC component can be extracted with high accuracy by adjusting the capacitance of the capacitor.

However, in the image forming apparatus including the plurality of light emitting elements, the APC is executed in a time sharing manner for each light beam during a period (non-image forming period) in which the light beam is emitted to an area (non-image area) outside an image forming area on the photosensitive member. Therefore, the time period for charging or discharging the capacitor is not always constant, and thus it is difficult to remove the offset component with high accuracy in the conventional art.

SUMMARY OF THE INVENTION

In view of this, the present invention provides an image forming apparatus configured to remove an offset component of a light receiving element.

In order to solve the above-mentioned problem, an image forming apparatus according to one embodiment of the present invention includes:

a laser light source configured to emit laser light, the laser light source being supplied with a bias current and a superimposed current which is superimposed on the bias current;

a splitting unit configured to split the laser light, which is emitted from the laser light source supplied with a current obtained by superimposing the superimposed current on the bias current, into first laser light and second laser light, the first laser light exposing a photosensitive member;

a photoelectric conversion unit configured to receive the second laser light to output a voltage corresponding to a light intensity of the received second laser light;

a voltage holding unit configured to hold a voltage output from the photoelectric conversion unit in a state in which the bias current is supplied to the laser light source, but the superimposed current is not supplied to the laser light source;

a voltage conversion unit configured to remove the voltage held by the voltage holding unit from the voltage output from the photoelectric conversion unit which receives the second laser light; and a current control unit configured to control, based on a voltage converted by the voltage conversion unit, a value of the superimposed current to be supplied to the laser light source based on image data.

Further features of the present invention will become apparent from the following description of exemplary embodiments with reference to the attached drawings.

DESCRIPTION OF THE EMBODIMENTS

Now, embodiments of the present invention will be described with reference to the drawings.

First Embodiment

Image Forming Apparatus

Figure 6:
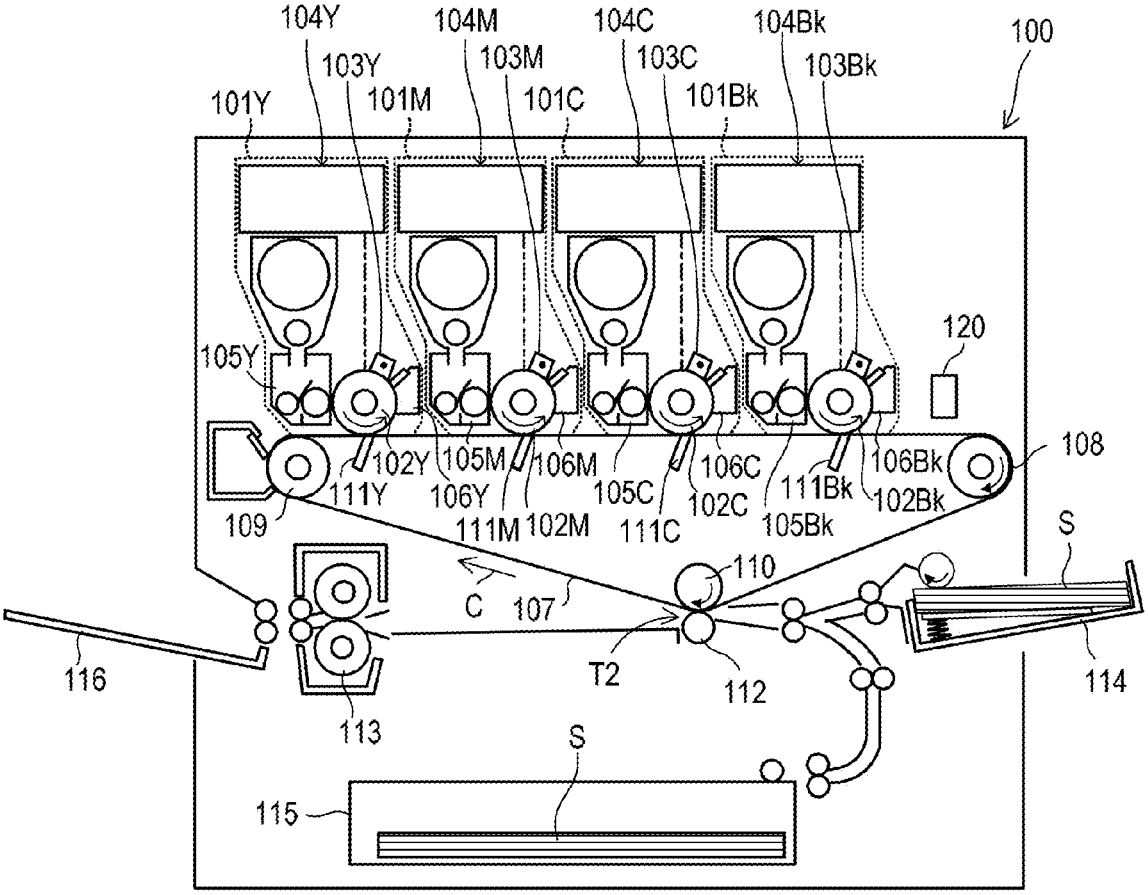
FIG. 6 is a sectional view of an image forming apparatus.

FIG. 6 is a sectional view of an image forming apparatus 100. The image forming apparatus 100 illustrated in FIG. 6 is a digital full-color printer configured to form a color image by use of toners of a plurality of colors. However, the present invention is not limited to the image forming apparatus 100 configured to form a color image, and is applicable to an image forming apparatus configured to form a monochrome image by use of toner of a single color (for example, black toner) alone.

First, the image forming apparatus 100 according to the embodiment will be described with reference to FIG. 6. The image forming apparatus 100 includes four image forming units 101 (101Y, 101M, 101C, and 101Bk) configured to respectively form images of different colors. Suffixes Y, M, C, and Bk represent yellow, magenta, cyan, and black, respectively. The image forming units 101Y, 101M, 101C, and 101Bk form images by using toners of yellow, magenta, cyan, and black, respectively.

The image forming units 101Y, 101M, 101C, and 101Bk include photosensitive drums (photosensitive members) 102 (102Y, 102M, 102C, and 102Bk), respectively, serving as image bearing members. Charging devices 103Y, 103M, 103C, and 103Bk, light scanning devices 104Y, 104M, 104C, and 104Bk, developing devices 105Y, 105M, 105C, and 105Bk, and drum cleaning devices 106Y, 106M, 106C, and 106Bk are arranged around the photosensitive drums 102Y, 102M, 102C, and 102Bk, respectively.

An intermediate transfer belt (intermediate transfer member) 107 of an endless belt type is arranged under the photosensitive drums 102Y, 102M, 102C, and 102Bk. The intermediate transfer belt 107 is passed over a drive roller 108 and driven rollers 109 and 110, and rotates in a direction indicated by the arrow C of FIG. 6 during image formation. Further, primary transfer devices 111Y, 111M, 111C, and 111Bk are respectively arranged at positions opposed to the photosensitive drums 102Y, 102M, 102C, and 102Bk across the intermediate transfer belt 107.

The image forming apparatus 100 according to the embodiment further includes a secondary transfer device 112 configured to transfer the toner image on the intermediate transfer belt 107 to a recording medium S and a fixing device 113 configured to fix the toner image on the recording medium S.

Image Forming Apparatus

First, a charging step to a developing step of an image forming process of the image forming apparatus 100 will be described. The charging step to the developing step is the same in each of the image forming units 101Y, 101M, 101C, and 101Bk. In the following, the charging step to the developing step with respect to the image forming unit 101Y will be described, and a description of the charging step to the developing step with respect to the image forming units 101M, 101C, and 101Bk will be omitted.

In the image forming unit 101Y, the charging device 103Y uniformly charges the surface of the rotating photosensitive drum 102Y. The uniformly charged surface of the photosensitive drum 102Y is exposed with a light beam emitted from the light scanning device 104Y. With this operation, an electrostatic latent image is formed on the rotating photosensitive drum 102Y. The electrostatic latent image is developed into a yellow toner image by the developing device 105Y.

Next, a transfer step and subsequent steps of the image forming process of the image forming apparatus 100 will be described. Transfer biases are applied to the primary transfer devices 111Y, 111M, 111C, and 111Bk so that the yellow, magenta, cyan, and black toner images formed on the photosensitive drums 102Y, 102M, 102C, and 102Bk, respectively, are primarily transferred onto the intermediate transfer belt 107. The toner images of the four colors are superimposed on the intermediate transfer belt 107.

The four-color toner images superimposed on the intermediate transfer belt 107 are secondarily transferred by the secondary transfer device 112 onto the recording medium S that has been conveyed from a manual feeding cassette 114 or a sheet feeding cassette 115 to a secondary transfer portion T2. Then, the toner images on the recording medium S are fixed onto the recording medium S by being heated and pressurized by the fixing device 113. Thus, a full-color image is formed on the recording medium S. The recording medium S on which the full-color image is formed is discharged onto a discharging unit 116.

The toners remaining on the photosensitive drums 102Y, 102M, 102C, and 102Bk after the primary transfer are removed by the drum cleaning devices 106Y, 106M, 106C, and 106Bk, respectively.

In case of a continuous image formation, the above-mentioned image forming process is repeated.

The image forming apparatus 100 carries out a density adjusting operation of keeping the image density constant. A density detecting sensor 120 is arranged opposite to the intermediate transfer belt 107. In the density adjusting operation, the density detecting sensor 120 detects the density of each of the colors of the toner images formed on the intermediate transfer belt 107. Each of the light scanning devices 104Y, 104M, 104C, and 104Bk adjusts the light intensity of the corresponding light beam so that the detected density of the corresponding color of the toner image has a predetermined value. With this, the density of an image to be formed by the image forming apparatus 100 is kept constant.

Light Scanning Device

Next, the light scanning devices 104 (104Y, 104M, 104C, and 104Bk) will be described with reference to FIGS. 4, 5A, and 5B. The image forming apparatus 100 has four light scanning devices 104 illustrated in FIG. 5A mounted thereon. The four light scanning devices 104Y, 104M, 104C, and 104Bk each have the same structure, and hence the suffix Y, M, C, or Bk representing color is omitted in the following description. In the embodiment, four light scanning devices 104 are used, but the present invention is also applicable to a single light scanning device which emits four light beams for scanning the four photosensitive drums 102.

Figure 4:
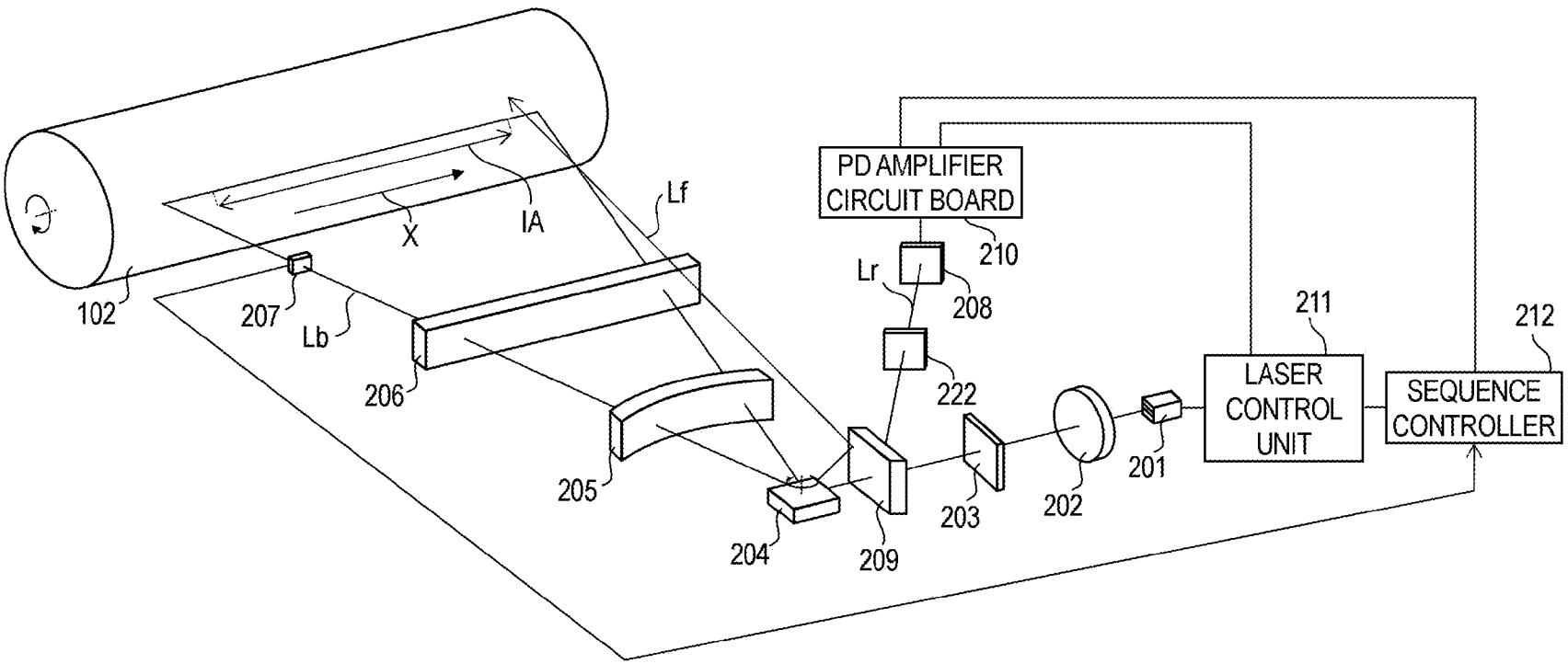
FIG. 4 is a schematic view illustrating components and light paths of a light scanning device.
Figure 5A:
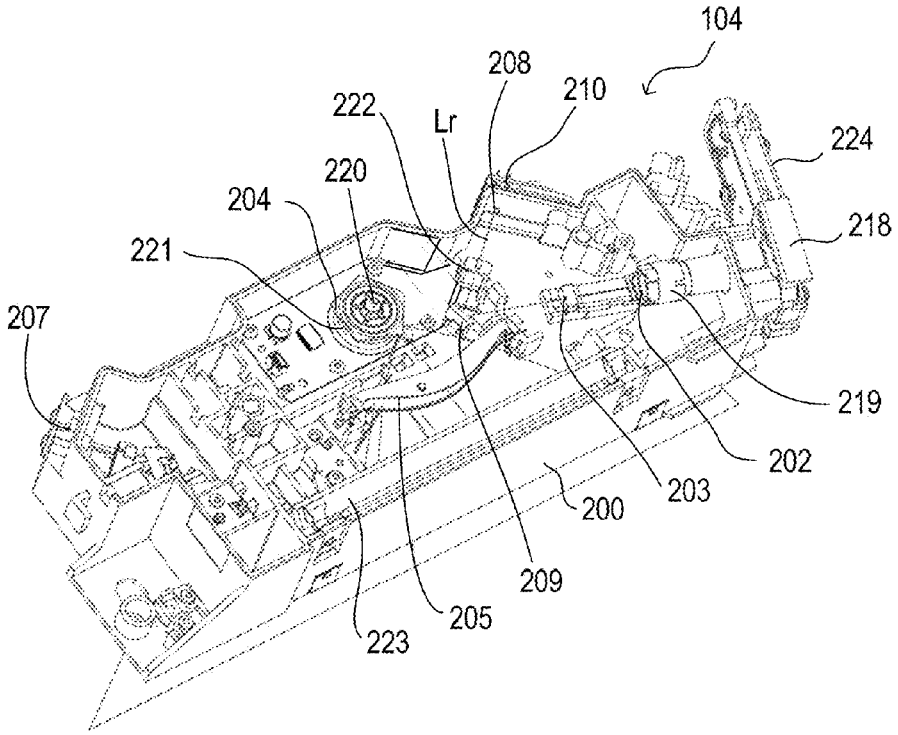
FIG. 5A is a perspective view of the light scanning device.
Figure 5B:
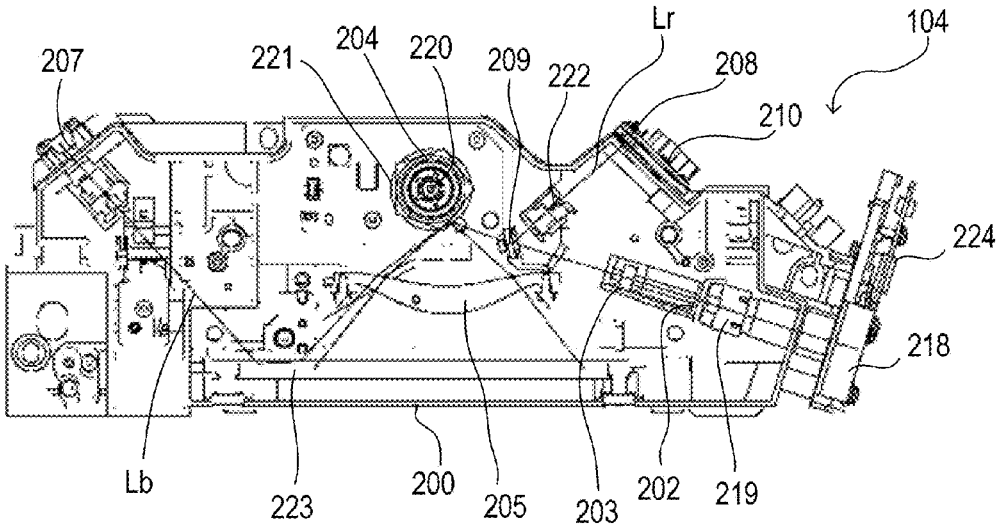
FIG. 5B is a plan view of the light scanning device.
Figure 7:
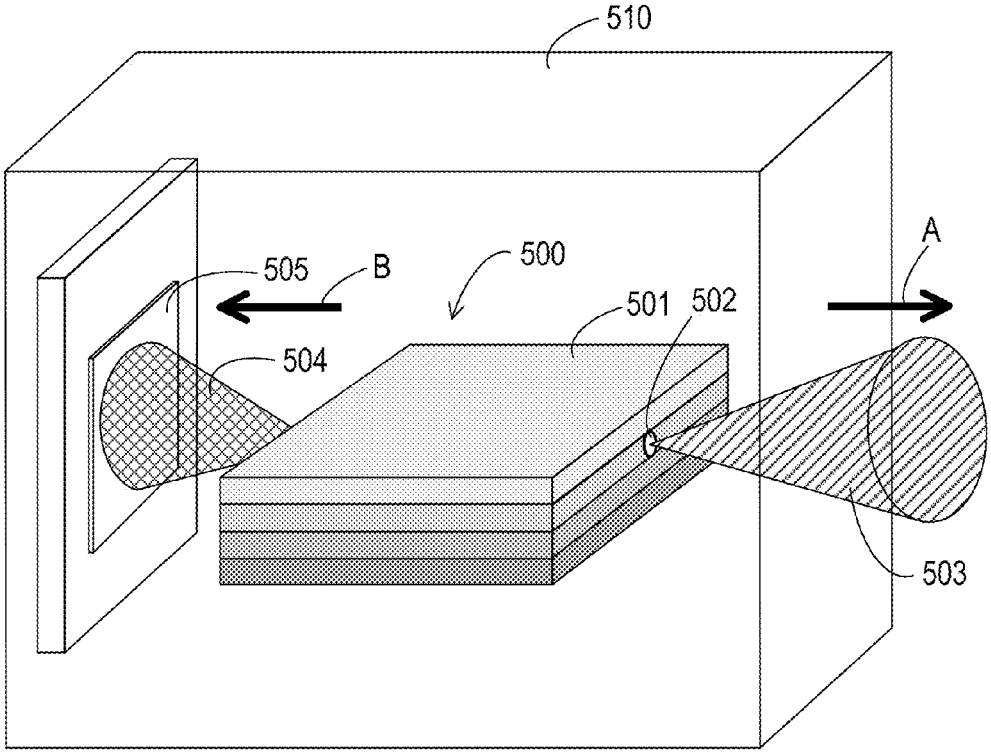
FIG. 7 is a schematic view of a package of an edge emitting laser.
Figure 8:
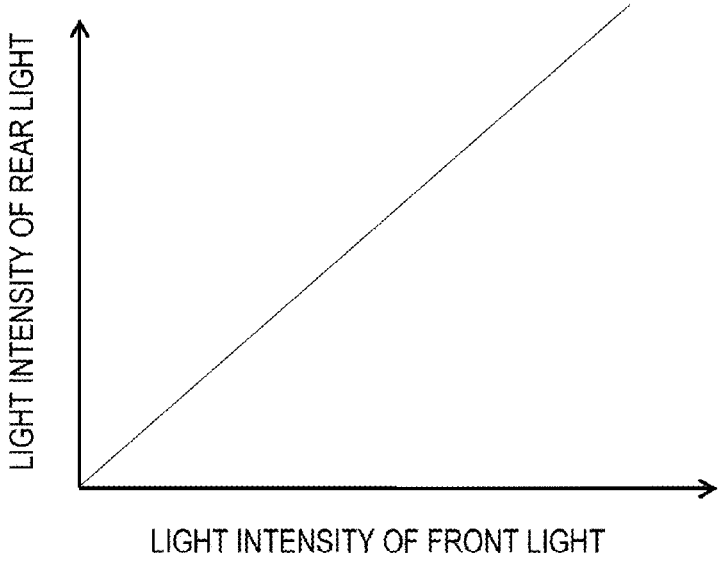
FIG. 8 is a graph showing a relationship between a light intensity of a front light and a light intensity of a rear light of the edge emitting laser.
Figure 9:
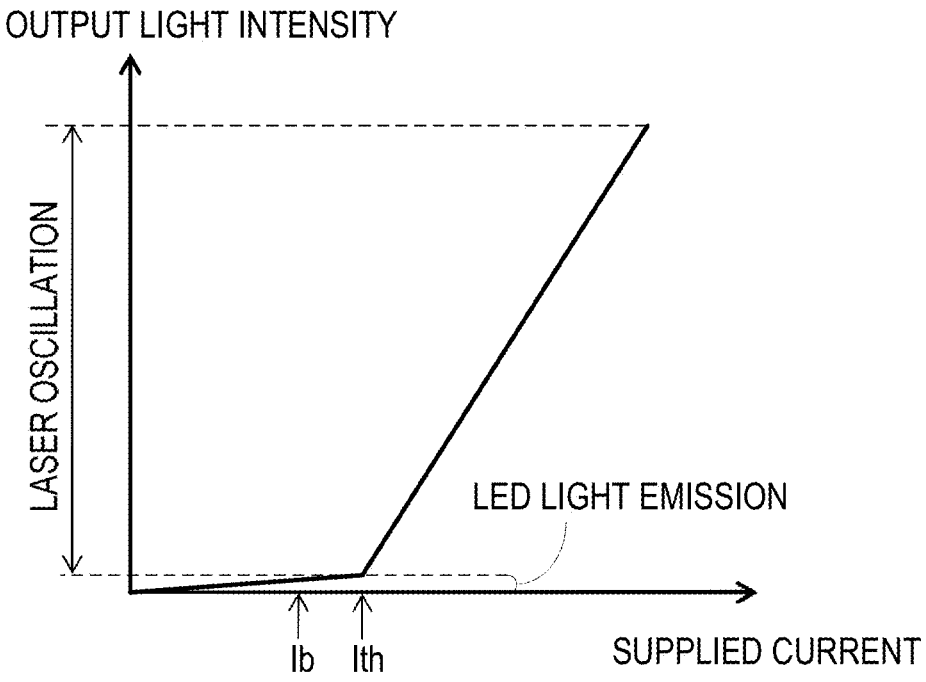
FIG. 9 is a graph showing a relationship between a current supplied to a semiconductor laser and an output light intensity.

FIGS. 5A and 5B are views illustrating the light scanning device (light beam emitting device) 104. FIG. 5A is a perspective view of the light scanning device 104. FIG. 5B is a plan view of the light scanning device 104. FIG. 4 is a schematic view illustrating components and light paths of the light scanning device 104.

As illustrated in FIG. 5A, the light scanning device 104 includes an optical box 200. Inside the optical box 200, various optical members to be described below are arranged.

As illustrated in FIG. 4, the light scanning device 104 includes a semiconductor laser (hereinafter referred to as "light source") 201 configured to emit a light beam, and a rotary polygon mirror (deflecting unit) 204 configured to deflect the light beam emitted from the light source 201 in a main scanning direction. The light source (laser light source) 201 is held by a light source unit 218 mounted on the optical box 200. The rotary polygon mirror 204 is fixed to a rotary shaft 220 of a motor 221 so as to be rotated by the motor 221.

The light scanning device 104 includes a collimator lens 202 configured to shape a light beam emitted from the light source 201 into collimated light, and a cylindrical lens 203 configured to condense the light beam that has passed through the collimator lens 202 in a sub-scanning direction. The collimator lens 202 is held by a barrel portion 219 of the light source unit 218.

The main scanning direction is a direction perpendicular to a rotation axis (rotary shaft 220) of the rotary polygon mirror 204, and is a direction in which the light beam is deflected by the rotary polygon mirror 204. The sub-scanning direction is a direction parallel to the rotation axis (rotary shaft 220) of the rotary polygon mirror 204, and is a direction perpendicular to the main scanning direction.

The light scanning device 104 includes a beam splitter (splitting unit) 209 configured to split the light beam that has passed through the cylindrical lens 203 into two light beams. The beam splitter 209 reflects part of the incident light beam, and transmits the remaining part of the incident light beam. In the embodiment, the beam splitter 209 is a half mirror. A light beam (first light beam) Lb which has transmitted through the beam splitter 209 is guided to the rotary polygon mirror 204. The rotary polygon mirror 204 deflects the light beam Lb so that the light beam Lb scans the photosensitive drum 102. A light beam (second light beam) Lr reflected by the beam splitter 209 is condensed by a condensing lens 222 so as to enter a photodiode (light receiving element) (hereinafter abbreviated to as PD) 208. The PD (photoelectric conversion unit) 208 which functions as a light intensity detecting unit is held by the optical box 200 of the light scanning device 104. The PD 208 is arranged at a position for receiving the light beam Lr, and outputs a detection signal of intensity corresponding to the received light intensity.

The light scanning device 104 includes a first fθ lens 205 and a second fθ lens 206 which the light beam deflected by the rotary polygon mirror 204 enters. Further, the light scanning device 104 includes a mirror 223 (FIG. 5A) configured to reflect the light beam that has passed through the first fθ lens 205 so that the reflected light beam passes through the second fθ lens 206 toward the photosensitive drum 102.

The light scanning device 104 includes a beam detector (hereinafter abbreviated to as BD) 207 configured to detect the light beam Lb deflected by the rotary polygon mirror 204. The BD 207 serves as a signal generating unit configured to output a sync signal. The sync signal is used to keep a writing start position of an image at a fixed position in the main scanning direction.

The light scanning device 104 includes a laser control unit 211 configured to control the light intensity and drive of the light beam emitted from the light source 201, and a sequence controller (signal outputting device) 212 configured to send an automatic light intensity control signal (APC signal) to the laser control unit 211. The laser control unit 211 and the sequence controller 212 are provided on a printed circuit board 224 supported by the light source unit 218.

The light scanning device 104 includes a PD amplifier circuit board 210 configured to convert a current output from the PD 208 into a voltage. The PD amplifier circuit board 210 is mounted on the optical box 200.

Light Source

Figure 3:
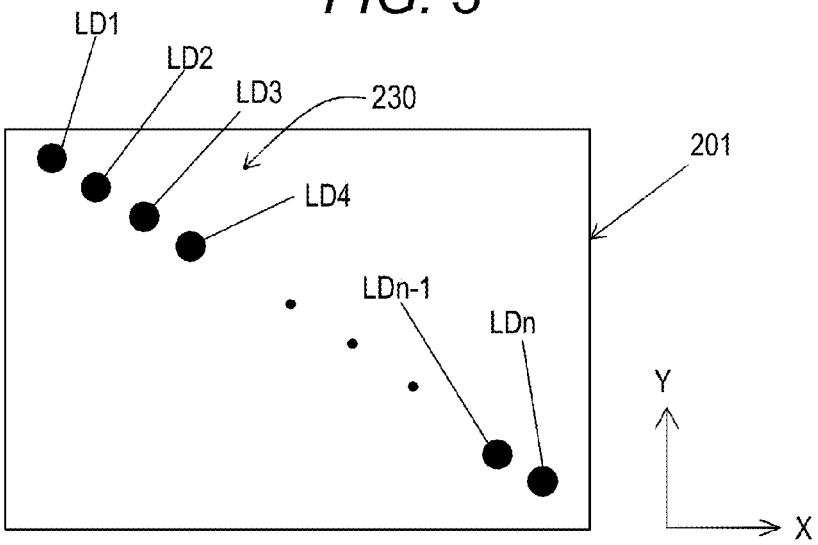
FIG. 3 is a front view of the light source.

FIG. 3 is a front view of the light source 201. The light source 201 will be described with reference to FIG. 3. In the embodiment, the light source 201 is a surface emitting laser. Examples of the surface emitting laser include a vertical cavity surface emitting laser (VCSEL), and a vertical external cavity surface emitting laser (VECSEL) having an external resonator. The present invention is not limited to the surface emitting laser, and may employ an edge emitting laser with a reflecting mirror on one edge of the edge emitting laser.

The light source 201 includes a surface emitting laser array 230 in which a plurality of light emitting elements (light emitting points) LD (LD1, LD2, LD3, LD4, . . . LDn−1, and LDn) configured to emit light beams are arrayed. The light emitting elements LD1, LD2, LD3, LD4, . . . LDn−1, and LDn emit light beams L1, L2, L3, L4, . . . Ln−1, and Ln, respectively.

The X-axis direction of FIG. 3 corresponds to a direction (main scanning direction) in which the light beam deflected by the rotary polygon mirror 204 scans on the photosensitive drum 102. The Y-axis direction of FIG. 3 corresponds to a rotation direction (sub-scanning direction) of the photosensitive drum 102.

The plurality of light emitting elements LD are arranged in an array as illustrated in FIG. 3. The plurality of light emitting elements LD are arrayed in the order of LD1, LD2, LD3, LD4, . . . LDn−1, and LDn in the main scanning direction X, and are arrayed at constant intervals in the sub-scanning direction Y. The light emitting elements LD of a number "n" are arrayed as illustrated in FIG. 3, and hence the light beams L1 to Ln emitted from the respective light emitting elements LD are imaged at different positions on the photosensitive drum 102 in the main scanning direction X. Also, the light beams L1 to Ln emitted from the respective light emitting elements LD1 to LDn are imaged at different positions on the photosensitive drum 102 in the sub-scanning direction Y.

In the embodiment, the plurality of light emitting elements LD are aligned in a substantially straight line, but may be arrayed two-dimensionally.

Control Circuit Configuration

Figure 1:
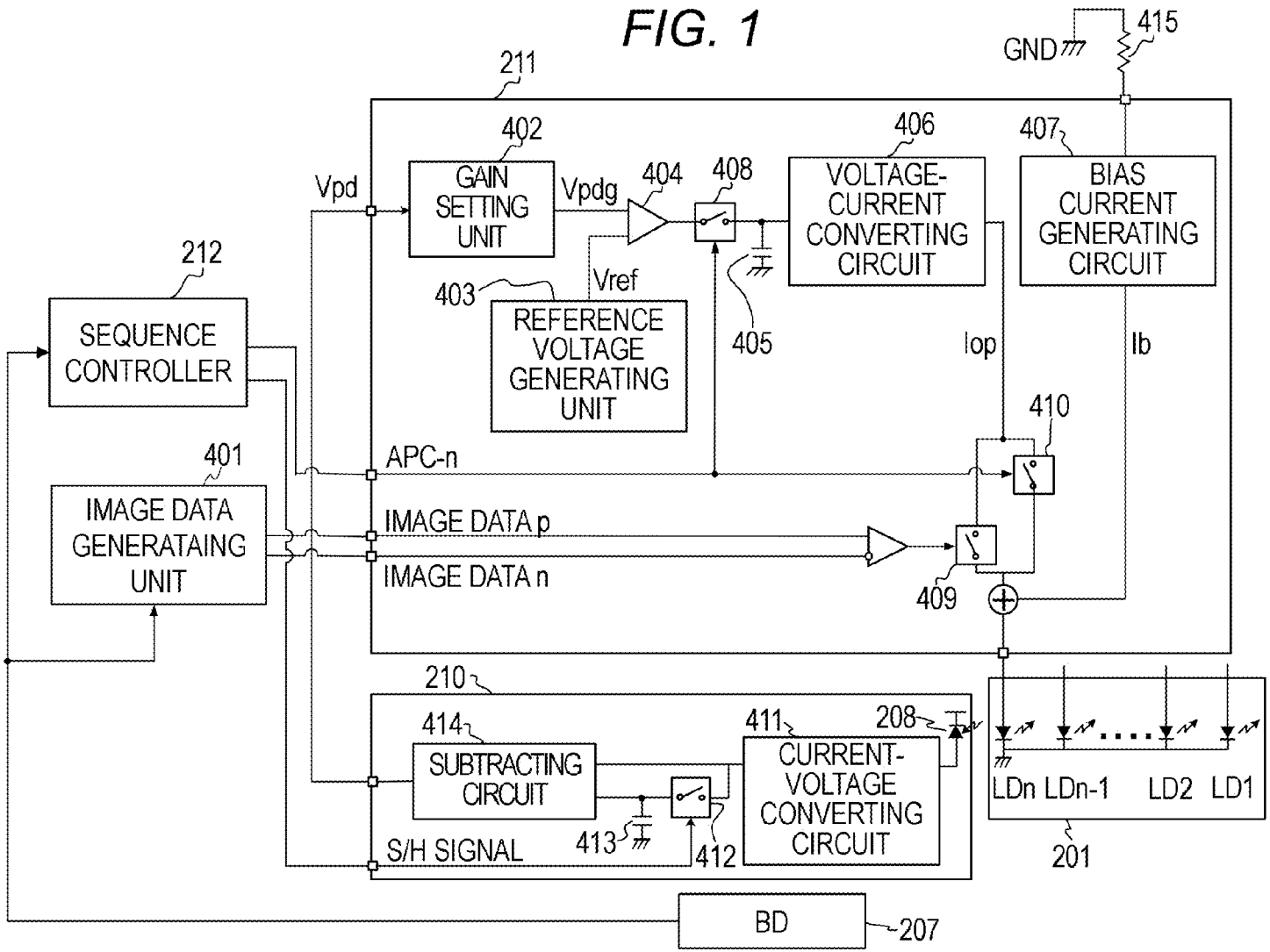
FIG. 1 is a block diagram illustrating a configuration of a control circuit configured to control a light source according to a first embodiment.

FIG. 1 is a block diagram illustrating a configuration of a control circuit configured to control the light source 201. A plurality of the laser control units 211 are electrically connected to the respective light emitting elements LD1, LD2, LD3, LD4, . . . LDn−1, and LDn of the light source 201. The plurality of laser control units 211 control drive of the respective light emitting elements LD1, LD2, LD3, LD4, . . . LDn−1, and LDn of the light source 201. The plurality of laser control units 211 function as current control units configured to control values of currents to be supplied to the respective light emitting elements LD1, LD2, LD3, LD4, . . . LDn−1, and LDn of the light source 201. The plurality of laser control units 211 are electrically connected to the sequence controller 212, the PD amplifier circuit board 210, and an image data generating unit 401. FIG. 1 illustrates only the laser control unit 211 connected to the light emitting element LDn of the light source 201.

The sequence controller 212 is electrically connected to the BD 207. When the sequence controller 212 receives the sync signal from the BD 207, the sequence controller 212 outputs an APC-n signal and a sample and hold signal (hereinafter referred to as S/H signal) at the respective timings synchronized with the sync signal of the BD 207 based on a program installed in advance. The sequence controller 212 outputs the APC-n signal to the laser control unit 211 at the timing to perform APC of the light emitting element LDn. The sequence controller 212 outputs the S/H signal to the PD amplifier circuit board 210 at the timing to sample an offset component output from the PD 208 when the light source 201 does not emit light.

The image data generating unit 401 sends image data "p" and "n" based on a job from a user to the laser control unit 211 at a predetermined timing synchronized with the output of the BD 207.

The output timings of the respective signals will be described later.

Laser Control Unit

With reference to FIG. 1, the laser control unit 211 connected to the light emitting element LDn of the light source 201 will be described. The laser control units 211 connected to the light emitting elements LD1 to LDn−1 have a similar configuration to the laser control unit 211 connected to the light emitting element LDn, and hence a description thereof is omitted.

The laser control unit 211 controls the light intensity of the light beam emitted from the light emitting element LDn so that the light intensity of the light beam Lr received by the PD 208 matches a target light intensity.

The laser control unit 211 includes a gain setting unit 402, a reference voltage generating unit 403, a comparator 404, an APC sample and hold capacitor 405, a voltage-current converting circuit 406, a bias current generating circuit 407, a switch 408, a switch 409, and a switch 410. The laser control unit 211 is an IC. The gain setting unit 402 has a gain value which is set in advance so that the emission intensity of the light emitting element LDn of the light source 201 matches a predetermined value in order that the light intensity of the light beam Lr received by the PD 208 matches the target light intensity. When an input voltage Vpd from the PD amplifier circuit board 210 is input to the gain setting unit 402, the gain setting unit 402 multiplies the input voltage Vpd by the gain value set in advance so as to output an output voltage Vpdg. The gain value set in advance is a value to be adjusted in factories, and details thereof are omitted herein.

The comparator 404 compares the output voltage Vpdg with a reference voltage Vref generated by the reference voltage generating unit 403.

The comparator 404 outputs a current when the following expression is satisfied:

$$Vpdg<Vref \quad \text{(Expression 1)},$$

sinks a current when the following expression is satisfied:

$$Vpdg>Vref \quad \text{(Expression 2), and}$$

neither outputs nor sinks a current when the following expression is satisfied:

$$Vpdg=Vref \quad \text{(Expression 3)}.$$

The switch 408 enters an on-state when the APC-n signal is input from the sequence controller 212 to the laser control unit 211, and enters an off-state when the APC-n signal is not input from the sequence controller 212 to the laser control unit 211.

When the comparator 404 outputs a current in the on-state of the switch 408, the APC sample and hold capacitor (hereinafter abbreviated to as APC S/H capacitor) 405 stores charges in accordance with the output current. When the comparator 404 sinks a current in the on-state of the switch 408, the APC S/H capacitor 405 discharges charges in accordance with the sink current. The APC S/H capacitor 405 generates a voltage corresponding to the stored charges. Further, the APC S/H capacitor 405 holds the stored charges when the switch 408 is in the off-state.

The voltage-current converting circuit 406 outputs a current (superimposed current) Iop of a value corresponding to the voltage generated by the APC S/H capacitor 405.

The switch 410 enters an on-state when the APC-n signal is input from the sequence controller 212 to the laser control unit 211, and enters an off-state when the APC-n signal is not input from the sequence controller 212 to the laser control unit 211. When the switch 410 enters the on-state at the timing to start the APC, the voltage-current converting circuit 406 supplies the current Iop to the light emitting element LDn of the light source 201. The light emitting element LDn emits the light beam Ln when receiving the current Iop. In this state, the emission intensity of the light emitting element LDn is controlled so as to match a predetermined light intensity. A mode of causing the light emitting element LDn to emit light in order to detect the light intensity of the light beam Ln as described above is hereinafter referred to as APC light emitting mode.

The switch 409 is turned on and off based on the image data from the image data generating unit 401 to perform on-off drive on the light source 201.

The bias current generating circuit 407 generates a bias current Ib based on a resistance value of an externally-connected bias current determining resistor 415, and supplies the bias current Ib to the light emitting element LDn. The value of the bias current Ib may be controlled by APC, for example.

PD Amplifier Circuit Board

The PD amplifier circuit board 210 includes the PD 208, a current-voltage converting circuit 411, a switch 412, a sample and hold capacitor (charge holding device, hereinafter referred to as S/H capacitor) 413, and a subtracting circuit (subtractor) 414.

The PD 208 receives the light beam Lr, which is output from the light emitting element LDn and split by the beam splitter 209, so as to output a current (first detection signal) corresponding to the light intensity of the light beam. The current-voltage converting circuit 411 converts the current from the PD 208 into a voltage.

The switch 412 enters an on-state when the S/H signal (switching signal) from the sequence controller (switch control unit) 212 is input to the PD amplifier circuit board 210. The PD 208 outputs a current (second detection signal) due to the dark current and the LED light from the light source 201 during a period in which the light source 201 does not emit a light beam. The current-voltage converting circuit 411 converts the current from the PD 208 into a voltage. The S/H capacitor 413 samples the voltage output from the current-voltage converting circuit 411 when the switch (switching device) 412 is in the on-state. The S/H capacitor 413 holds the sampled voltage when the switch 412 is in an off-state.

The subtracting circuit 414 outputs, as the input voltage Vpd, a voltage obtained by subtracting the voltage sampled by the S/H capacitor 413 from the voltage output from the current-voltage converting circuit 411.

The laser control unit 211 controls the light intensity of the light beam emitted by the light source 201 based on the intensity of the first detection signal and the intensity of the second detection signal.

BD

The BD 207 outputs the sync signal to the sequence controller 212 and the image data generating unit 401 at the timing of incidence of the light beam Lb.

Cause of Occurrence of Flare Light

Next, with reference to FIG. 4, the principle of occurrence of flare light in the light scanning device 104 will be described. As described above, in the image forming apparatus 100, the light beam emitted from the light source 201 is deflected by the rotary polygon mirror 204, and the deflected light beam scans on the photosensitive drum 102 to form an image. The light source 201 emits a light beam for image formation within such a predetermined angular range of the rotary polygon mirror 204 that the light beam deflected by the rotary polygon mirror 204 scans on an image forming area IA of the photosensitive drum 102 in the main scanning direction X. A mode in which the light beam is emitted for image formation at the timing (hereinafter referred to as an image forming period) at which the light beam emitted from the light source 201 scans on the image forming area IA of the photosensitive drum 102 as described above is hereinafter referred to as an image forming light emitting mode. In order to prevent the light beam for APC from scanning on the image forming area IA of the photosensitive drum 102, the sequence controller 212 outputs the APC signal at the timing (hereinafter referred to as a non-image forming period) other than the predetermined angular range of the rotary polygon mirror 204 to execute the APC. That is, the light beam for the APC is emitted in the non-image forming period other than the image forming period. The bias current Ib is supplied to each of the light emitting elements in both of the image forming period and the non-image forming period.

However, many optical components are arranged in the light scanning device 104, and hence even the light beam emitted in the non-image forming period may be diffusely reflected to enter the photosensitive drum 102. For example, as illustrated in FIG. 4, even the light beam emitted in the non-image forming period may be diffusely reflected by the beam splitter 209 so that flare light Lf enters the image forming area IA of the photosensitive drum 102. Therefore, in order to prevent the light source 201 from emitting light at the timing of occurrence of the flare light Lf, the timing of occurrence of the flare light Lf is set to a light emission inhibiting period in which the light source 201 is inhibited from emitting light beam.

Further, even the light beam emitted in the non-image forming period may be diffusely reflected by the optical components in the light scanning device 104 so that the diffused reflection light enters the PD 208. When the APC is executed at this timing, light (diffused reflection light) other than the light beam Lr also enters the PD 208, and hence the accuracy of light intensity detection is reduced. Therefore, at this timing, the APC cannot be executed. Also this timing is the light emission inhibiting period in which the light source 201 is controlled not to emit light beam.

The above-mentioned diffused reflection light is collectively referred to as a flare light.

S/H Signal Output Timing

Figure 2:
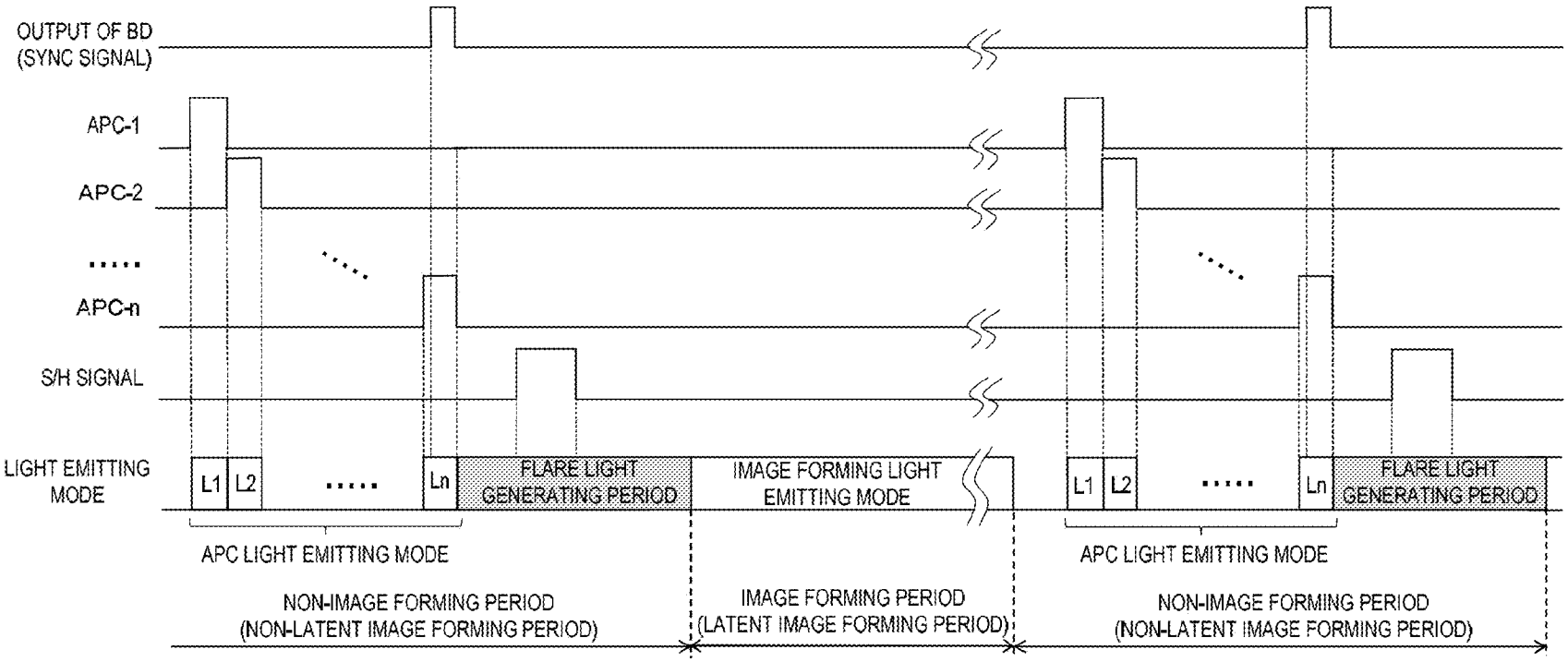
FIG. 2 is a timing chart illustrating the signal generating timing.

FIG. 2 is a timing chart illustrating the signal generating timing. FIG. 2 illustrates the sync signal output from the BD 207, the APC-1 to APC-n signals and the S/H signal output from the sequence controller 212, and the light emitting mode.

As illustrated in FIG. 2, during one scanning period in which the light beam scans on the photosensitive drum 102 in the main scanning direction, the image forming period (latent image forming period) and the non-image forming period (non-latent image forming period) are present. The sequence controller 212 counts a clock signal by a built-in counter on the basis of the sync signal, to identify the image forming period (latent image forming period) and the non-image forming period (non-latent image forming period) in one scanning period.

The APC for the light beams L1 to Ln to be emitted from the respective light emitting elements LD1 to LDn is executed for each light beam by outputting the APC-1 to APC-n signals in a time sharing manner during the non-image forming period (APC light emitting mode). In the embodiment, at the timing to execute the APC for the light beam Ln, the light beam Ln enters the BD 207 as the light beam Lb to obtain the sync signal from the BD 207.

In the image forming light emitting mode, the APC is not executed, and the light source 201 emits the light beam based on image data from the image data generating unit 401. The image forming period includes the image forming light emitting mode.

In the embodiment, in order to remove the offset component (dark current component) of the PD 208, in the non-image forming period other than the APC light emitting mode, the bias current Ib is supplied to each of the light emitting elements, and the output of the PD 208 is sampled and held in a state in which each of the light emitting elements does not perform laser oscillation. In the embodiment, when the PD 208 is in a sampling mode, only the bias current Ib is supplied to each of the light emitting elements, and the current Iop to be superimposed on the bias current Ib based on the image data is not supplied to each of the light emitting elements. The sampled and held output is subtracted from the output of the PD 208 in the APC light emitting mode by the subtracting circuit 414, to remove, from the output of the PD 208, the influences of the dark current and the LED light of the light emitting element LD. That is, the subtracting circuit 414 functions as a voltage conversion unit.

In the embodiment, the timing to set the PD 208 into the sampling mode may be arbitrary as long as the timing is within the non-image forming period in one scanning period. However, because the APC is executed in a time sharing manner in a case where the image forming apparatus includes a plurality of light emitting elements, when the PD 208 is set into the sampling mode at an arbitrary timing in the non-image forming period, a period for executing the APC may not be sufficiently secured. This leads to reduction in the number of the light emitting elements that execute the APC in one scanning period.

In view of this, in the embodiment, in a period (light emission inhibiting period) (hereinafter referred to as a flare light occurrence period) from the acquisition of the sync signal to the image forming light emitting mode (start of the image forming period), the sequence controller 212 is controlled to output the S/H signal to the PD amplifier circuit board 210. The non-image forming period includes the APC light emitting mode and the flare light occurrence period (light emission inhibiting period).

The flare light occurrence period may be the timing at which the light beam for the APC is not emitted in the non-image forming period and at which if the light beam is emitted, the light beam enters the photosensitive drum 102. Alternatively, the flare light occurrence period may be the timing at which if the light beam is emitted, the light beam is reflected by components other than the beam splitter 209 in the light scanning device 104 to enter the PD 208 in the non-image forming period.

In a state in which a light beam does not enter the PD 208, the PD 208 outputs a current due to the dark current of the PD 208 and the LED light of the light emitting element LD. The PD amplifier circuit board 210 samples, as a voltage, the output current of the PD 208 in the state in which the light beam does not enter the PD 208 in one scanning period. The subtracting circuit 414 subtracts the sampled voltage from the output voltage (to which the output current is converted) of the PD 208 in the APC light emitting mode. With this, without reducing the time for the APC, the influences of the dark current of the PD 208 and the LED light of the light emitting element LD are removed.

According to the embodiment, it is possible to remove the influences of the dark current of the PD 208 and the LED light of the light emitting element LD in the APC without reducing the time for the APC. In this manner, even when the light intensity of the light beam entering the PD 208 is low, the light intensity of the light beam to be emitted from the light source 201 can be controlled with high accuracy.

Second Embodiment

Figure 10:
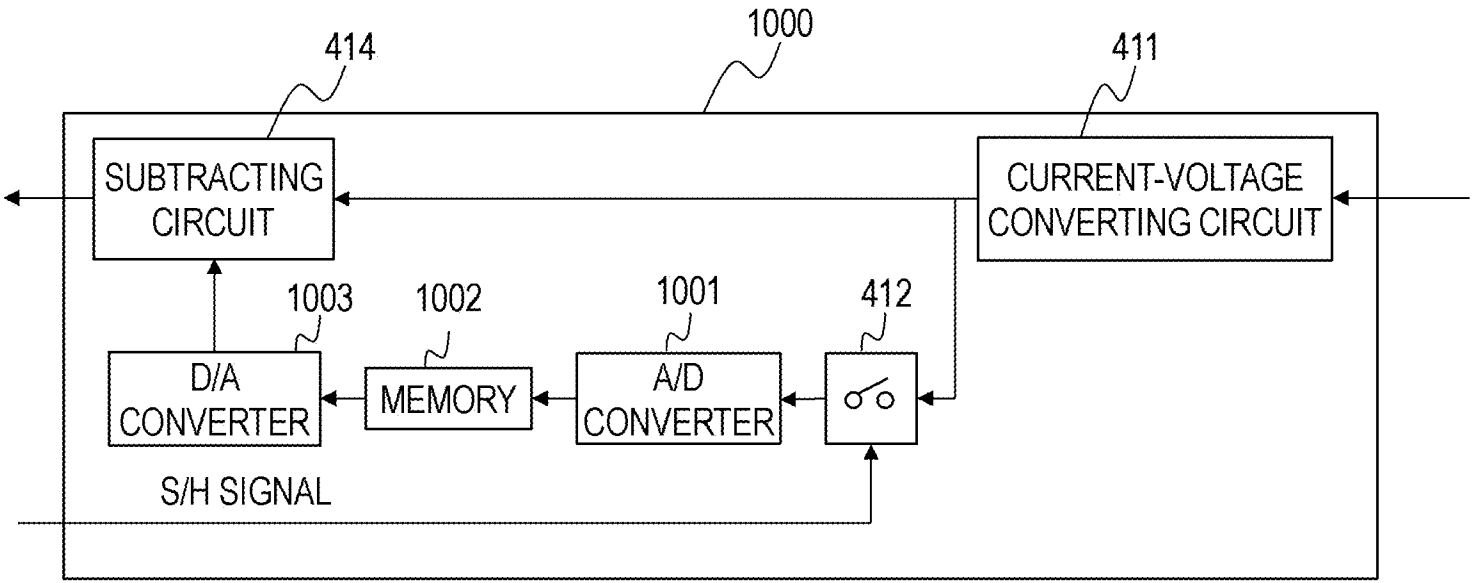
FIG. 10 is a block diagram illustrating a PD amplifier circuit board according to a second embodiment.

In the first embodiment, the capacitor 413 is used as a configuration configured to hold the offset component, but the embodiment is not limited thereto. For example, instead of the PD amplifier circuit board 210, a PD amplifier circuit board 1000 may be provided. FIG. 10 is a block diagram illustrating the PD amplifier circuit board 1000 according to a second embodiment. The PD amplifier circuit board 1000 includes an A/D converter 1001, a memory (storage unit) 1002, and a D/A converter 1003 in addition to the current-voltage converting circuit 411, the switch 412, and the subtracting circuit 414. The A/D converter 1001, the memory 1002, and the D/A converter 1003 function as a voltage holding unit in the same as in the capacitor 413. The A/D converter 1001 converts the voltage output from the current-voltage converting circuit 411 into digital data (for example, 8-bit data) when the switch 412 is turned on (in the sampling state). The memory 1002 temporarily holds the digital data converted by the A/D converter 1001. The D/A converter 1003 converts the digital data held by the memory 1002 into analog data when the switch 412 is turned off (in a holding state), and outputs the analog data. The subtracting circuit 414 subtracts the output voltage of the D/A converter 1003 from the voltage output from the current-voltage converting circuit 411. Even with such a configuration, an effect similar to that of the first embodiment can be obtained.

As another configuration, data input from the current-voltage converting circuit 411 to the subtracting circuit 414 may be digital data, and from the digital data, digital data held by the memory 1002 may be subtracted, and then the resultant digital data may be converted into a voltage which is output to the laser control unit 211.

Further, as another configuration, data input from the current-voltage converting circuit 411 to the subtracting circuit 414 may be digital data, and form the digital data, digital data held by the memory 1002 may be subtracted, and then the resultant digital data may be output to the laser control unit 211. In this case, the laser control unit 211 is a unit which operates based on the resultant digital data.

Third Embodiment

Figure 11:
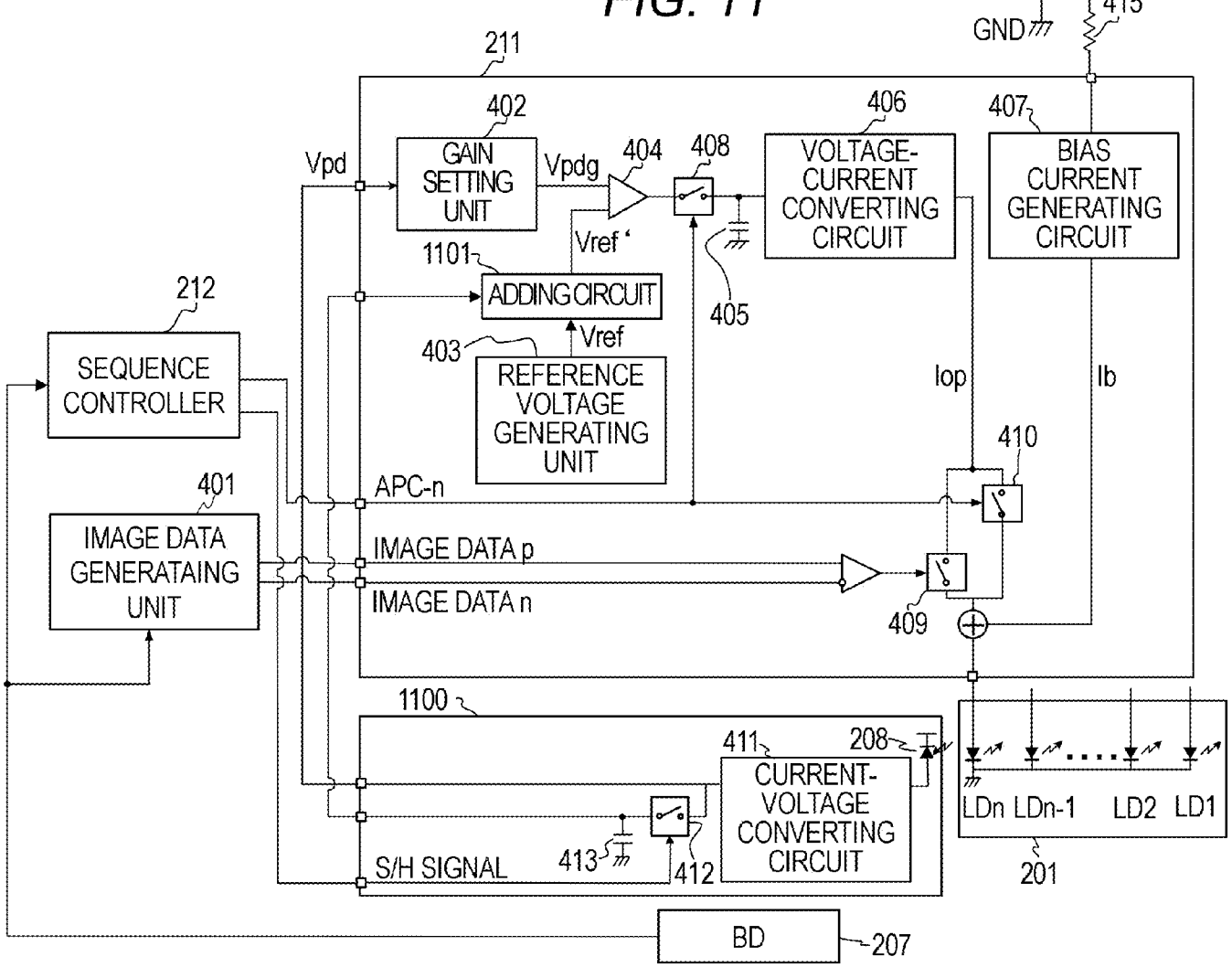
FIG. 11 is a block diagram illustrating a configuration of a control circuit configured to control a light source according to a third embodiment.

In the first and second embodiments, the apparatus including the PD amplifier circuit board 210 or 1000 configured to generate the input voltage Vpd whose offset component is removed is described. In the third embodiment, in order to remove the influences of the offset components, an apparatus configured to generate a reference voltage Vref based on the offset component will be described. FIG. 11 is a control block diagram according to the third embodiment. The units denoted by the same reference symbols as those in FIG. 1 have like functions, and hence a description thereof is omitted.

The third embodiment differs from the first embodiment in that a PD amplifier circuit board 1100 does not include the subtracting circuit 414, but the laser control unit 211 includes an adding circuit 1101. The adding circuit 1101 is connected to the capacitor 413 on the PD amplifier circuit board 1100 and the reference voltage generating unit 403, and respective voltages from the capacitor 413 and the reference voltage generating unit 403 are input to the adding circuit 1101. The adding circuit 1101 outputs, to the comparator 404, a voltage Vref' obtained by adding the voltage of the capacitor 413 to the voltage Vref of the reference voltage generating unit 403. The comparator 404 charges and discharges the capacitor 405 based on the result of comparison between Vpdg and Vref'.

As described above, by correcting the reference voltage to be input to the comparator 404 based on the offset component, an effect similar to that in the first embodiment can be obtained. The third embodiment may adopt the configuration described in the second embodiment as the configuration configured to sample the offset component. The reference voltage generating unit 403 and the adding circuit 1101 may be provided outside the laser control unit 211. In this case, the output of the adding circuit 1101 is input to the laser control unit 211, and then input to the comparator 404.

According to the embodiments, the offset component of the light receiving element can be removed without reducing the time for the APC.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-181921, filed Sep. 3, 2013, which is hereby incorporated by reference herein in its entirety.

What is claimed is:

1. An image forming apparatus, comprising:

a laser light source configured to emit laser light, the laser light source being supplied with a bias current and a superimposed current which is superimposed on the bias current;

a splitting unit configured to split the laser light, which is emitted from the laser light source supplied with a current obtained by superimposing the superimposed current on the bias current, into first laser light and second laser light, the first laser light exposing a photosensitive member;

a photoelectric conversion unit configured to receive the second laser light to output a voltage corresponding to a light intensity of the received second laser light;

a voltage holding unit configured to hold a voltage output from the photoelectric conversion unit in a state in which the bias current is supplied to the laser light source, but the superimposed current is not supplied to the laser light source;

a voltage conversion unit configured to remove the voltage held by the voltage holding unit from the voltage output from the photoelectric conversion unit which receives the second laser light; and a current control unit configured to control, based on a voltage converted by the voltage conversion unit, a value of the superimposed current to be supplied to the laser light source based on image data.

2. An image forming apparatus according to claim 1, further comprising:

a deflecting unit configured to deflect the first laser light, the first laser light deflected by the deflecting unit exposing the photosensitive member;

a switch provided between the photoelectric conversion unit and the voltage holding unit; and a switch control unit configured to control the switch to turn on the switch at a timing at which the first laser light deflected by the deflecting unit does not scan on the photosensitive member, wherein, by the switch being turned on, the voltage holding unit holds the voltage output from the photoelectric conversion unit in the state in which the bias current is supplied to the laser light source, but the superimposed current is not supplied to the laser light source.

3. An image forming apparatus according to claim 2, wherein the laser light source comprises a plurality of light emitting points each configured to emit the laser light, a plurality of second laser lights corresponding to the plurality of light emitting points, respectively, entering the photoelectric conversion unit, and wherein the voltage holding unit holds a voltage output from the photoelectric conversion unit in a state in which the bias current is supplied to each of the plurality of light emitting points, but the superimposed current is not supplied to a corresponding one of the plurality of light emitting points.

4. An image forming apparatus according to claim 3, wherein the current control unit controls, based on the voltage converted by the voltage conversion unit, the superimposed current to be supplied to each of the plurality of light emitting points based on the image data.

5. An image forming apparatus according to claim 1, wherein the voltage holding unit comprises a capacitor, and wherein the voltage conversion unit subtracts a voltage of the capacitor from the voltage output from the photoelectric conversion unit which receives the second laser light.

6. An image forming apparatus according to claim 1, wherein the voltage holding unit comprises:

an A/D converter configured to A/D convert the voltage output from the photoelectric conversion unit in the state in which the bias current is supplied to the laser light source, but the superimposed current is not supplied to the laser light source;

a storage unit configured to store digital data output from the A/D converter; and a D/A converter configured to convert the digital data stored in the storage unit to an analog voltage, and wherein the voltage conversion unit subtracts the analog voltage output from the D/A converter from the voltage output from the photoelectric conversion unit which receives the second laser light.

7. An image forming apparatus according to claim 1, wherein the voltage holding unit comprises:

an A/D converter configured to A/D convert the voltage output from the photoelectric conversion unit in the state in which the bias current is supplied to the laser light source, but the superimposed current is not supplied to the laser light source; and a storage unit configured to store digital data output from the A/D converter, and wherein the voltage output from the photoelectric conversion unit which receives the second laser light is converted based on the digital data stored in the storage unit.

* * * * *